US009630078B2

(12) United States Patent
Mueller

(10) Patent No.: US 9,630,078 B2
(45) **Date of Patent: *Apr. 25, 2017**

(54) RING STICKS GAME SYSTEM

(76) Inventor: Steven T. Mueller, Clearwater, FL (US)

( * ) Notice: Subject to any disclaimer, the term of this patent is extended or adjusted under 35 U.S.C. 154(b) by 672 days.

This patent is subject to a terminal disclaimer.

(21) Appl. No.: 13/552,136

(22) Filed: Jul. 18, 2012

(65) Prior Publication Data

US 2014/0021684 A1 Jan. 23, 2014

(51) Int. Cl.

| | |
|---|---|
| ***A63B 67/06*** | (2006.01) |
| ***A63B 65/00*** | (2006.01) |
| ***A63B 59/30*** | (2015.01) |
| *A63H 33/00* | (2006.01) |
| *A63H 33/18* | (2006.01) |
| *A63B 67/08* | (2006.01) |

(52) U.S. Cl.

CPC ..... *A63B 65/00* (2013.01); *A63B 59/30* (2015.10); *A63B 67/06* (2013.01); *A63B 67/086* (2013.01); *A63B 2207/00* (2013.01); *A63H 33/009* (2013.01); *A63H 33/18* (2013.01)

(58) Field of Classification Search

CPC ..... A63H 33/009; A63H 33/18; A63H 33/02; A63B 59/30; A63B 67/086

USPC ..... 273/412; 473/514; 446/450, 473; D21/568

See application file for complete search history.

(56) References Cited

U.S. PATENT DOCUMENTS

| | | | | | |
|---|---|---|---|---|---|
| 1,529,851 | A | * | 3/1925 | Smithson | 473/514 |
| 1,662,278 | A | * | 3/1928 | Nelson | 273/412 |
| 2,120,075 | A | * | 6/1938 | Roosman | 473/514 |
| 2,127,433 | A | * | 8/1938 | Sky | 473/514 |
| 2,371,567 | A | * | 3/1945 | Wilson | 473/514 |
| 2,436,174 | A | * | 2/1948 | Myers | 473/569 |
| 2,826,859 | A | * | 3/1958 | Shaffer | 446/197 |
| 2,832,597 | A | * | 4/1958 | Brennan | 473/506 |
| 3,659,849 | A | * | 5/1972 | Seymour | 473/514 |
| D249,079 | S | * | 8/1978 | Soderman et al. | D21/723 |
| 4,174,834 | A | * | 11/1979 | De Martino | 473/514 |
| 4,819,947 | A | * | 4/1989 | Mackey | 273/412 |
| 5,181,875 | A | * | 1/1993 | Hasegawa | 446/15 |
| 5,389,033 | A | * | 2/1995 | Rauch | 446/473 |
| 5,421,584 | A | * | 6/1995 | Planinc et al. | 473/514 |
| 5,788,590 | A | * | 8/1998 | Ervin | 473/514 |
| 6,347,973 | B1 | * | 2/2002 | Grant et al. | 446/450 |
| 7,665,453 | B1 | * | 2/2010 | D'Agostino | 124/5 |
| D650,867 | S | * | 12/2011 | Mueller | D21/568 |

(Continued)

*Primary Examiner* — Mark Graham

(57) ABSTRACT

Four swords and at least one ring. Each sword has integrally formed handle, blade, and intermediate sections, and top and bottom surfaces with interior and exterior edges. Each generally oval handle section has grasping and shielding regions. Each thin, elongated and curved blade section has upper and lower ends with a convex interior edge and a concave exterior edge and slots extending between the top and bottom surfaces along its length. Each intermediate section has at least one projection extending from one of the edges. Each ring has an outer edge in a circular configuration, an inner edge with circumferential arcs which receives the exterior edges of blade sections of two crossed swords. The blade sections when aimed and rapidly uncrossed project the ring toward the upper ends of the blade sections and beyond for receipt by the sword of another player for subsequent projecting.

8 Claims, 3 Drawing Sheets

(56) References Cited

U.S. PATENT DOCUMENTS

| | | | | |
|---|---|---|---|---|
| D655,353 | S * | 3/2012 | Hara et al. | D21/568 |
| 2009/0118101 | A1* | 5/2009 | Reinhardt et al. | 482/12 |
| 2010/0048097 | A1* | 2/2010 | Ma | 446/473 |
| 2010/0136881 | A1* | 6/2010 | Tong | 446/473 |

* cited by examiner

RING STICKS GAME SYSTEM

RELATED APPLICATION

The present application is an improvement over my prior application U.S. patent application Ser. No. 29/370,805 filed Sep. 7, 2010, now U.S. Pat. No. D650,867 issued Dec. 20, 2011.

BACKGROUND OF THE INVENTION

Field of the Invention

The present invention relates to a ring sticks game system and more particularly pertains to bringing enjoyment to players and observers, increasing speed, agility, and endurance of the players, and creating competition between individual players and teams of players in a safe, convenient and economical manner.

Description of the Prior Art

The use of sword games and ring toss games of known designs and configurations is known in the prior art. More specifically, sword games and ring toss games of known designs and configurations previously devised and utilized for the purpose of enjoyment, exercise, and competition are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned devices do not describe a ring sticks game system that allows for bringing enjoyment to players and observers, increasing speed, agility, and endurance of the players, and creating competition between individual players and teams of players in a safe, convenient and economical manner.

In this respect, the ring sticks game system according to the present invention substantially departs from the conventional concepts and designs of the prior art, and in doing so provides an apparatus primarily developed for the purpose of bringing enjoyment to players and observers, increasing speed, agility, and endurance of the players, and creating competition between individual players and teams of players in a safe, convenient and economical manner.

Therefore, it can be appreciated that there exists a continuing need for a new and improved ring sticks game system which can be used for bringing enjoyment to players and observers, increasing speed, agility, and endurance of the players, and creating competition between individual players and teams of players in a safe, convenient and economical manner. In this regard, the present invention substantially fulfills this need.

SUMMARY OF THE INVENTION

In view of the foregoing disadvantages inherent in the known types of sword games and ring toss games of known designs and configurations now present in the prior art, the present invention provides an improved ring sticks game system. As such, the general purpose of the present invention, which will be described subsequently in greater detail, is to provide a new and improved ring sticks game system and method which has all the advantages of the prior art and none of the disadvantages.

To attain this, the present invention essentially comprises four swords and at least one ring. Each sword has integrally formed handle, blade, and intermediate sections, and top and bottom surfaces with interior and exterior edges. Each generally oval handle section has grasping and shielding regions. Each thin, elongated and curved blade section has upper and lower ends with a convex interior edge and a concave exterior edge and slots extending between the top and bottom surfaces along its length. Each intermediate section has at least one projection extending from one of the edges. Each ring has an outer edge in a circular configuration and an inner edge with circumferential arcs which receives the exterior edges of blade sections of two crossed swords. The blade sections when aimed and rapidly uncrossed project the ring toward the upper ends of the blade sections and beyond for receipt by the sword of another player for subsequent projecting.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ring sticks game system which has all of the advantages of the prior art sword games and ring toss games of known designs and configurations and none of the disadvantages.

It is another object of the present invention to provide a new and improved ring sticks game system which may be easily and efficiently manufactured and marketed.

It is further object of the present invention to provide a new and improved ring sticks game system which is of durable and reliable constructions.

An even further object of the present invention is to provide a new and improved ring sticks game system which is susceptible of a low cost of manufacture with regard to both materials and labor, and which accordingly is then susceptible of low prices of sale to the consuming public, thereby making such ring sticks game system economically available to the buying public.

Lastly, it is an object of the present invention to provide a new and improved ring sticks game system for bringing enjoyment to players and observers, for increasing speed, agility, and endurance of the players, for creating competition between individual players and teams of players. The bringing enjoyment, the increasing speed and endurance, and the creating competition are done in a safe, convenient and economical manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
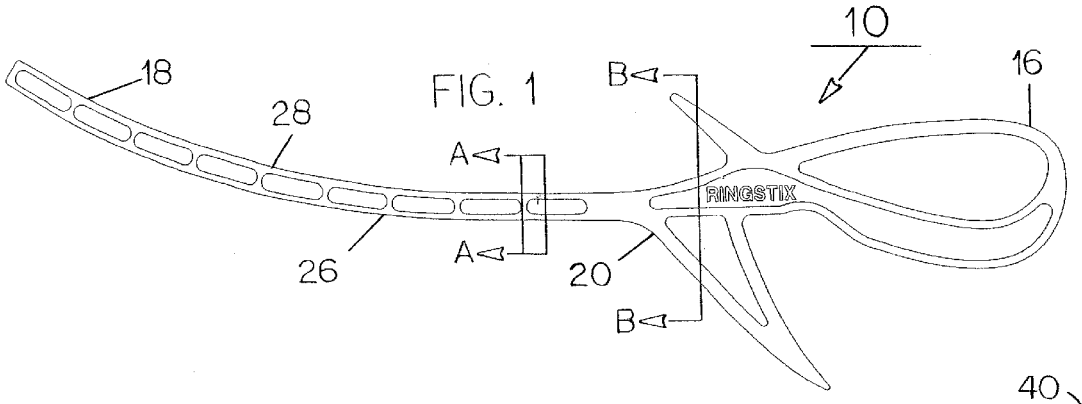
FIG. 1 is front elevational view of a sword of a ring sticks game system constructed in accordance with the principles of the present invention.
Figure 2:
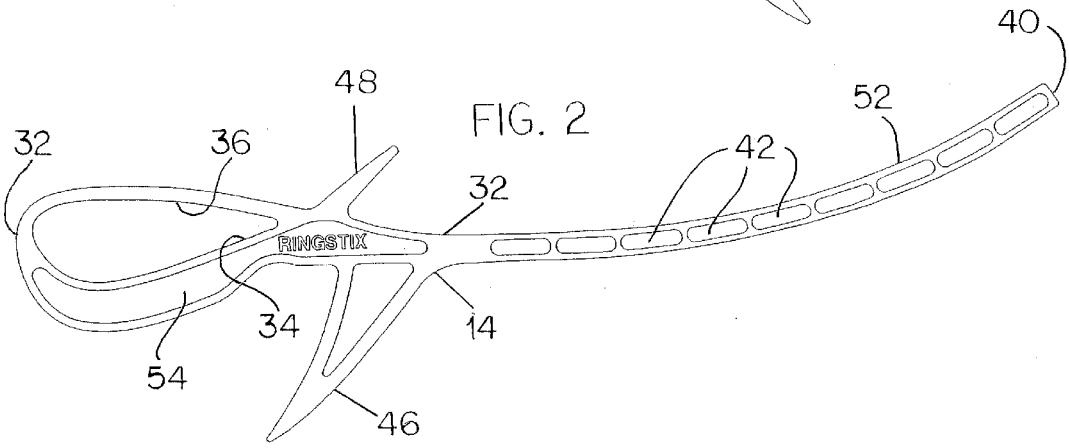
FIG. 2 is a rear elevational view of the sword of the ring sticks game system illustrated in FIG. 1.
Figure 8:
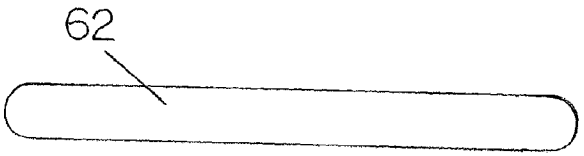
FIG. 8 is a side elevational view of the ring of the ring sticks game system illustrated in FIG. 8.
Figure 1B:
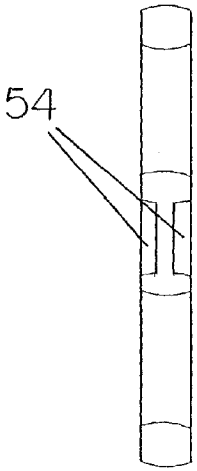
FIG. 1B is a cross-sectional view of the sword of the ring sticks game system taken along line B-B of FIG. 1.
Figure 1A:
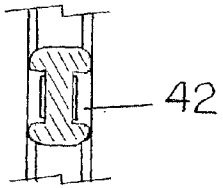
FIG. 1A is a cross-sectional view of the sword of the ring sticks game system taken along line A-A of FIG. 1.
Figure 7:
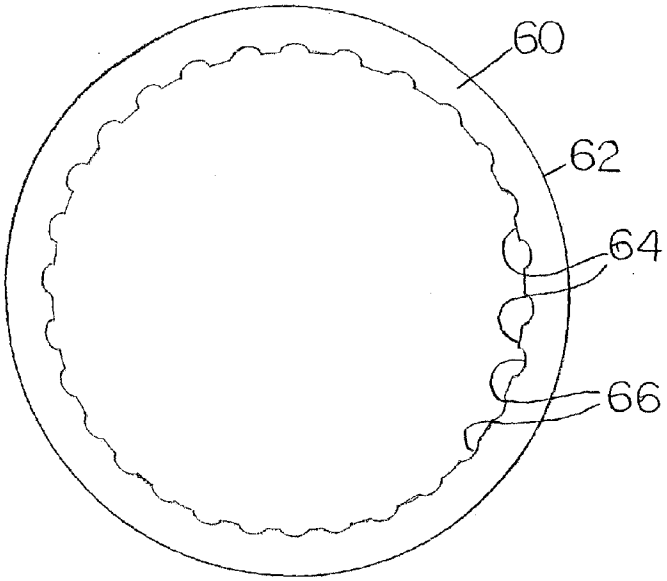
FIG. 7 is a plan view of the ring of the ring sticks game system constructed in accordance with the principles of the present invention.
Figure 4:
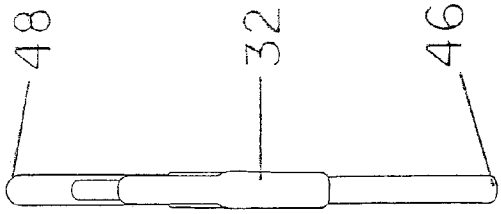
FIG. 4 is a right side elevational view of the sword of the ring sticks game system illustrated in FIG. 1.
Figure 3:
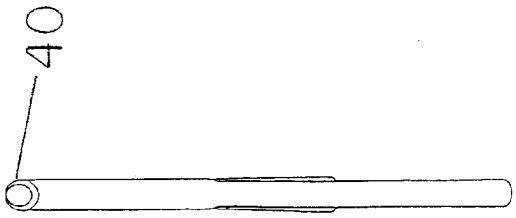
FIG. 3 is a left side elevational view of the sword of the ring sticks game system illustrated in FIG. 1.
Figure 5:
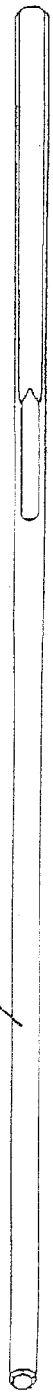
FIG. 5 is a plan view of the ring sticks game system illustrated in FIG. 1.
Figure 6:
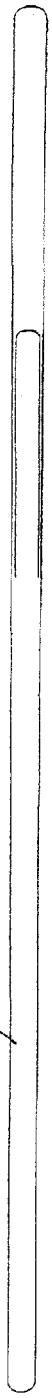
FIG. 6 is a bottom elevational view of the ring sticks game system illustrated in FIG. 1.

With reference now to the drawings, and in particular to FIG. 1 thereof, the preferred embodiment of the new and improved ring sticks game system embodying the principles and concepts of the present invention and generally designated by the reference numeral 10 will be described.

The present invention, the ring sticks game system 10 is comprised of a plurality of components. Such components in their broadest context include four swords and a ring. Such components are individually configured and correlated with respect to each other so as to attain the desired objective.

The ring sticks game system 10 of the present invention is for bringing enjoyment to players and observers, for increasing speed, agility, and endurance of the players, for creating competition between individual players and teams of players in a safe, convenient and economical manner.

First provided are four swords 14. Two of the swords are for each of two players. All of the swords are similarly configured. Each sword is formed of a handle section 16, a blade section 18, and an intermediate section 20. The intermediate section is between the handle and blade sections. The handle and intermediate and blade sections of each sword have a common central plane and form a top surface 22 and a bottom surface 24 and also form along each blade an interior edge 26 and an exterior edge 28.

The handle section has a free lower end 32 and an upper end formed integrally with the intermediate section. The handle section is in a generally oval configuration with a thicker grasping region 34 on the interior edge and a thinner hand shielding region 36 on the exterior edge.

The blade section has a free upper end 40 and a lower end formed integrally with the intermediate section. The blade section is thin and elongated in a curved configuration with the interior edge being convex and with the exterior edge being concave. The blade section has a plurality of oval slots 42 extending between the top and bottom surfaces along the length of the blade section.

Each intermediate section has an upper end formed integrally with the sword section. Each intermediate section has a lower end formed integrally with the handle section. Each intermediate section has a generally triangular large projection 46 for hand protecting purposes extending from the interior edge between the blade section and handle section. Each intermediate section has a generally triangular small projection 48 for ring limiting purposes extending from the exterior edge between the large projection and the handle section.

A major recess 52 is formed in the top and bottom surfaces of the blade section between the upper and lower ends. A minor recess 54 is formed in the top and bottom surfaces of the intermediate and handle sections. Indicia 56 is formed on the top and bottom surfaces of the intermediate section within the minor recess.

Lastly, a ring 60 is provided. The ring has an outer edge 62 in a circular configuration. The ring has an inner edge 64 with circumferential arcs 66. The arcs are adapted to receive the exterior edges of blade sections when the blade sections are crossed. The blade sections when aimed and rapidly uncrossed are adapted to project the ring toward the upper ends of the blade sections and beyond for receipt by the sword of another player for subsequent projecting. The ring is fabricated of a plastic with luminescent properties for utilizing the system at night. The swords are fabricated of plastic whereby when combined with the slots provides more flexibility to the interior edge of the blade section which results in an increased area of contact between the interior edge of the blade section and the inner edge of the ring being projected. The result is increased friction between the blade section and the ring which forces the ring to rotate faster after the launch and to better maintain its position in flight thereby making the ring easier to catch. Because of the slots, the blade sections are adapted to be made shorter and lighter thereby making them easier and more enjoyable for children to play.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ring sticks game sword having top and bottom surfaces with interior and exterior edges comprising:

a handle section in a generally oval configuration with grasping and shielding regions;

a blade section being thin and elongated in a curved configuration with the interior edge being convex and with the exterior edge being concave, the blade section having a plurality of slots extending between the top and bottom surfaces along the length of the blade section; and an intermediate section having upper and lower ends formed integrally with the blade and handle sections and with at least one projection extending from one of the edges, the at least one projection including a generally triangular large projection extending from the interior edge between the blade and handle sections; the intermediate section also having a generally triangular small projection for ring limiting purposes extending from the exterior edge between the large projection and the handle section.

2. The sword as set forth in claim 1 and further including:

a major recess formed in the top and bottom surfaces of the blade section between upper and lower ends.

3. The sword as set forth in claim 2 and further including:

a minor recess formed in the top and bottom surfaces of the intermediate and handle sections, indicia formed on the top and bottom surfaces of the intermediate section within the minor recess.

4. The sword as set forth in claim 1 being fabricated of plastic.

5. A ring sticks game system including:

at least two swords, each sword having top and bottom surfaces with interior and exterior edges, each sword having a handle section in a generally oval configuration with grasping and shielding regions, each sword having a blade section being thin and elongated in a curved configuration with the interior edge being convex and with the exterior edge being concave, the blade section having a plurality of slots extending between the top and bottom surfaces along the length of the blade section, and each sword having an intermediate section having upper and lower ends formed integrally with the blade and handle sections and with at least one projection extending from one of the edges; and at least one ring, each ring having an outer edge in a circular configuration, each ring having an inner edge with circumferential arcs, the arcs adapted to receive the exterior edges of blade sections when the blade sections are crossed, the blade sections when aimed and rapidly uncrossed adapted to project one of the rings toward the upper ends of the blade sections and beyond for receipt by the sword of another player for subsequent projecting.

6. The system as set forth in claim 5 wherein the at least one ring is fabricated of plastic with luminescent properties for utilizing the system at night.

7. A ring sticks game system (10) for bringing enjoyment to players and observers, and for increasing speed, agility, and endurance of the players, and for creating competition between individual players and teams of players, the bringing enjoyment and the increasing speed, agility, and endurance and the creating of competition being done in a safe, convenient and economical manner, the system comprising, in combination:

four swords (14), two swords of the four swords for each of two players, all of the swords being similarly configured, each sword being formed of a handle section (16) and a blade section (18) and an intermediate section (20) between the handle and blade sections, the handle and intermediate and blade sections of each sword having a common central plane and forming a top surface (22) and a bottom surface (24) and also forming along each blade an interior edge (26) and an exterior edge (28);

the handle section having a free lower end (32) and an upper end formed integrally with the intermediate section, the handle section being in a generally oval configuration with a thicker grasping region (34) on the interior edge and a thinner hand shielding region (36) on the exterior edge;

the blade section having a free upper end (40) and a lower end formed integrally with the intermediate section, the blade section being thin and elongated in a curved configuration with the interior edge being convex and with the exterior edge being concave, the blade section having a plurality of oval slots (42) extending between the top and bottom surfaces along the length of the blade section;

each intermediate section having an upper end formed integrally with the sword section, each intermediate section having a lower end formed integrally with the handle section, each intermediate section having a generally triangular large projection (46) for hand protecting purposes extending from the interior edge between the blade section and handle section, each intermediate section having a generally triangular small projection (48) for ring limiting purposes extending from the exterior edge between the large projection and the handle section;

a major recess (52) formed in the top and bottom surfaces of the blade section between the upper and lower ends, a minor recess (54) formed in the top and bottom surfaces of the intermediate and handle sections, indicia (56) formed on the top and bottom surfaces of the intermediate section within the minor recess; and a ring (60) having an outer edge (62) in a circular configuration, the ring having an inner edge (64) with circumferential arcs 66, the arcs adapted to receive the exterior edges of blade sections when the blade sections are crossed, the blade sections when aimed and rapidly uncrossed adapted to project the ring toward the upper ends of the blade sections and beyond for receipt by the sword of another player for subsequent projecting, the ring being fabricated of a plastic with luminescent properties for utilizing the system at night, the swords being fabricated of plastic whereby when combined with the slots provides more flexibility to the interior edge of the blade section which results in an increased area of contact between the interior edge of the blade section and the inner edge of the ring being projected resulting in increased friction between the blade section and the ring which forces the ring to rotate faster after the launch and to better maintain its position in flight thereby making the ring easier to catch.

8. A ring sticks game sword having top and bottom surfaces with interior and exterior edges comprising:

a handle section in a curved configuration with grasping and shielding regions a blade section being thin and elongated in a curved configuration with the interior edge being convex and with the exterior edge being concave, the blade having a reduced blade length;

an intermediate section having upper and lower ends formed integrally with the blade and handle sections, the intermediate section having an arcuate large projection extending from the interior edge between the blade and handle sections, the intermediate section also having a generally triangular small projection extending from the exterior edge between the large projection and the handle section, the sword having a reduced sword length.

* * * * *